US006892406B2

(12) United States Patent
Littlehorn

(10) Patent No.: US 6,892,406 B2
(45) Date of Patent: May 17, 2005

(54) NECK RING WITH DETACHABLE BIB

(75) Inventor: Sheila Littlehorn, Littleton, CO (US)

(73) Assignee: The Boppy Company, Golden, CO (US)

( * ) Notice: Subject to any disclaimer, the term of this patent is extended or adjusted under 35 U.S.C. 154(b) by 2 days.

(21) Appl. No.: 10/627,542

(22) Filed: Jul. 25, 2003

(65) Prior Publication Data

US 2005/0015881 A1 Jan. 27, 2005

(51) Int. Cl.[7] ..... A41B 13/00; A47G 9/00
(52) U.S. Cl. ..... 5/639; 2/49.1
(58) Field of Search ..... 5/639, 636, 655, 5/922; 2/49.1–49.5

(56) References Cited

U.S. PATENT DOCUMENTS

| | | | | |
|---|---|---|---|---|
| 1,898,272 | A | | 2/1933 | Stem |
| 2,078,022 | A | | 4/1937 | Roemer |
| 2,379,340 | A | | 6/1945 | Corbatt |
| 3,378,948 | A | | 4/1968 | Gervaise |
| 3,426,372 | A | | 2/1969 | Enelow |
| 3,608,964 | A | | 9/1971 | Earl |
| 3,840,918 | A | | 10/1974 | Shave |
| 4,197,604 | A | | 4/1980 | Nakamura |
| 4,236,264 | A | | 12/1980 | Britzman |
| 4,731,890 | A | | 3/1988 | Roberts |
| 4,914,765 | A | | 4/1990 | Smith |
| 5,154,649 | A | | 10/1992 | Pender |
| 5,193,235 | A | | 3/1993 | Kircher |
| 5,207,791 | A | | 5/1993 | Scherbarth |
| 5,261,134 | A | | 11/1993 | Matthews |
| 5,519,906 | A | | 5/1996 | Fanto-Chan |
| 5,546,620 | A | | 8/1996 | Matthews |
| 5,572,753 | A | | 11/1996 | Ruscitto |
| 5,581,833 | A | | 12/1996 | Zenoff |
| 5,661,861 | A | | 9/1997 | Matthews |
| 5,666,665 | A | | 9/1997 | Morgado |
| 5,675,853 | A | | 10/1997 | Linge |
| 5,881,382 | A | * | 3/1999 | Bernard et al. ..... 2/49.1 |
| 6,038,720 | A | | 3/2000 | Matthews et al. |
| 6,055,687 | A | | 5/2000 | Matthews |
| 6,119,873 | A | | 9/2000 | Matthews |
| 6,279,185 | B1 | | 8/2001 | Matthews |
| 6,412,128 | B1 | | 7/2002 | Matthews |
| 6,434,770 | B2 | | 8/2002 | Matthews Brown |
| 6,523,200 | B2 | | 2/2003 | Brown |
| 6,532,612 | B2 | | 3/2003 | Matthews Brown |

FOREIGN PATENT DOCUMENTS

| | | |
|---|---|---|
| FR | 2379268 | 9/1978 |
| GB | 1508809 | 4/1978 |
| WO | WO 94/09689 | 5/1994 |

* cited by examiner

*Primary Examiner*—Alexander Grosz
(74) *Attorney, Agent, or Firm*—Townsend and Townsend and Crew LLP

(57) ABSTRACT

A neck pillow system comprises a neck pillow comprising a pillow body having a medial region and two arms that each have an end. The arms extend from the medial region to form a generally open well, and the neck pillow is configured to be placed around the baby's neck, with the medial region being positioned at the baby's back and the two ends positioned at the baby's front. A bib is removably coupled to the pillow body near each of the ends to permit the bib to hang vertically down over the baby's chest.

18 Claims, 4 Drawing Sheets

NECK RING WITH DETACHABLE BIB

BACKGROUND OF THE INVENTION

This invention relates generally to the field of child products, and in particular to bibs. More specifically, the invention relates to the use of bibs that are attached to neck pillows.

Bibs have long been used to protect a child from becoming soiled. Bibs are most often used when a child is eating, although they may be used for other applications as well. Bibs are typically constructed of a piece of material that is coupled about the child's neck using a pair of strings or other fasteners, such as snaps of a hook and loop fastener material.

One particularly useful bib is described in U.S. Pat. No. 6,523,200. This invention is related to other types of bibs that may be used with neck pillows.

BRIEF SUMMARY OF THE INVENTION

The invention provides techniques for securing a bib to a person, such as a baby or a child. In one embodiment, a bib pillow system comprises a neck pillow that is constructed of a pillow body having a medial region and two arms that each have an end. The arms extend from the medial region to form a generally open well. The neck pillow is configured to be placed around a baby's neck, with the medial region being positioned at the back of the baby's neck and the two ends positioned near the front of the neck. A bib is removably coupled to the pillow body near each of the ends to permit the bib to hang vertically down over the baby's chest.

In one aspect, the bib includes a fastener to removably couple the bib to the ends. For example, the fastener may comprise a hook and loop fastener material, snaps, buttons or the like. In this way, the bib may easily be removed from the pillow. In some cases, the attachment location may be varied so that the bib may be coupled essentially anywhere along the arms. As such, the location of the bib along the pillow body may easily be varied.

In another aspect, the bib has a bottom end, a top end and two sides. The top end includes two extending regions and a recessed region, and the two extending regions are configured to be coupled to the two ends of the pillow. In one aspect, the bib has a length in the range from about 5 inches to about 10 inches and a width in the range from about 5 inches to about 10 inches. The extending regions may have a width of about 1 inch to about 3 inches and the recessed region may be recessed about 2 inches to about 3 inches.

In a further aspect, the pillow body comprises a fill material encased by a fabric cover. The bib may also be constructed of a fabric.

In a particular aspect, the medial region may have a width of about 0.5 inch to about 2 inches, the arms may have a width of about 1 inch to about 3 inches and a length of about 4 inches to about 6 inches. The arms of the pillow body may also increase in width as they extend away from the medial region. Further, the well may have a width of about 2 inches to about 4 inches. The ends may have a thickness in the range from about 0.75 inch to about 2 inches, and the thickness may increase in a direction away from the medial region.

In use, the pillow may be placed about the baby's neck, with the medial region being positioned at the baby's back and the two ends positioned at the baby's front. The bib is removably coupled to the pillow body near each of the ends, with the bib hanging vertically down over the baby's chest.

Typically, the bib may substantially cover the baby's chest. The arms of the pillow may also be used to support the baby's head in an upright orientation.

When ready to remove the bib, it is uncoupled from the pillow. If a hook and loop fastener material is used, it may be removed by simply pulling it from the pillow. The bib may then be washed, stored, or the like.

DETAILED DESCRIPTION OF THE INVENTION

Figure 1:
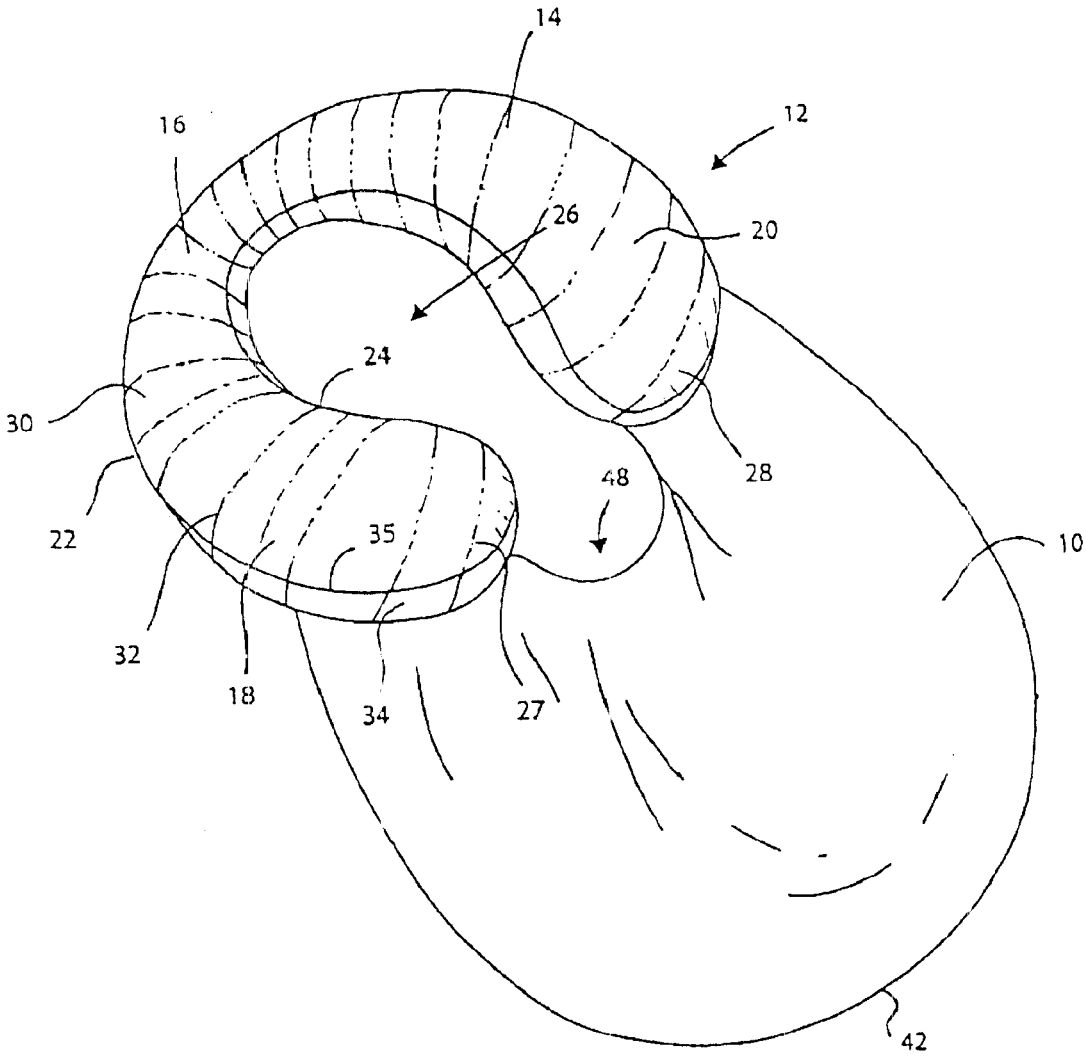
FIG. 1 is a perspective view of a bib system according to the invention.

The invention provides techniques for removably attaching a bib to a child or a baby. The techniques of the invention may be used with children of any age or size, including infants to older children, and could even be used for adults. The bibs are attached to the person by using a neck pillow that is placed about the person's neck and rests on the person's shoulders. The pillow may also serve to support the baby's head.

The neck pillow is constructed of a pillow body having a medial region and two opposing arms that define a generally open well for receiving the neck. The neck pillow may conveniently be constructed in a manner similar to the pillows described in U.S. Pat. Nos. 5,261,134; 5,661,861; 6,038,720; 6,055,687; 6,434,770; 6,352,612; 6,279,185; 6,412,128; 6,453,493; 6,119,873; 5,546,620; 6,523,200 6,523,200; and in copending U.S. application Ser. No. 09/662,935, filed Sep. 15, 2000, now U.S. Pat. No. 6,321, 403; Ser. No. 10/046,377, filed Oct. 26, 2001; Ser. No. 09,884,742, filed Jun. 18, 2001, now U.S. Pat. No. 6,671, 908; Ser. No. 09/679,139 filed Oct. 3, 2000; Ser. No. 09/802,097, filed Mar. 8, 2001; Ser. No. 10/426,067, filed Apr. 28, 2003, now U.S. Pat. No. 6,786,539; Ser. No. 10/612,267, filed on Jul. 1, 2003 and Ser. No. 10/618,432, filed on Jul. 10, 2003. The complete disclosures of all the references are herein incorporated by reference. However, it will be appreciated that other pillows that are capable of being placed about the neck may also be used, including U-shaped pillows, angular pillows and the like.

The neck pillows may have a well that is about 2 inches to about 4 inches across so that it is large enough to receive the child's neck without choking the child, but small enough so that the pillow remains secured about the neck. The pillow may have a variety of shapes so long as the pillow is able to remain secured to the neck. For example, the opposing arms may be straight, angled or curved. The medial region may have a shape and size that makes it comfortable against the back of the child's neck. For example, the medial region could be generally straight and have a minimal height. The arms may increase in height as they extend from the medial region. For instance, the medial region may be about 0.75 inch to about 1.5 inches in height, and the arms may go up to about 1.5 inches to about 2 inches in height. This enables the child the tilt his head backward, but still supports the sides from moving side to side.

The medial region may have a width of about 0.5 inch to about 2 inches. Also, the arms may have a width of about 1 inch to about 3 inches and a length of about 4 inches to about 6 inches. These dimensions permit the pillow to fit around the baby's neck without being too constrictive. The arms of the pillow body may also increase in width as they extend away from the medial region. This provides a greater surface area for attaching the bib as well assisting to support the baby's head.

The bib may conveniently be coupled to the arms near their ends so that when the ends of the arms are at the front of the child's neck, the bib hangs down over the child's chest. The location where the bib is coupled to the arms may vary depending on the user. In this way, the location may be adjusted to compensate for the size of the child. For example, the bib may be located within about 3 inches of the ends. Use of a hook and loops fastener material facilitates this adjustment.

The size of the bib may be configured according to the size of the child. In one embodiment, the bib has a length in the range from about 5 inches to about 10 inches and hangs down from the medial region by a distance of about 3 inches to about 10 inches, and in some cases may be longer, e.g., about 12 inches. Further, the bib may have a variety of shapes, such as rectangular, curved, scalloped, and the like.

The top end of the bib may have a recessed region and two extending regions. The extending regions are configured to be fastened to the ends of the arms of the pillow. The extending regions may have a width of about 1 inch to about 3 inches and the recessed region may be recessed about 2 inches to about 3 inches. The recessed region provides space for the child's neck. However, it will be appreciated that a wide variety of other shapes may be used, and that the invention is not intended to be limited to this specific configuration of bib. For example, the bibs could be rectangular, oval, round, and the like.

A variety of materials may be used to construct the bib. For example, the bib may be constructed of a fabric, such as a cotton or polyester cloth material, plastics, and the like. The bib may conveniently include one or more pockets for storing items or for simply catching food. The bib may be either integrally attached or removably attached to the pillow body. For example, the bib may be sewn or glued to the pillow body. Alternatively, a variety of fasteners may be used to removably attach the bib to the pillow body including buttons, snaps, a hook and loop fastener material, or the like. In some cases, the bib may be fixed to one of the ends while being removably connected to the other end. In additional to being removably connected, the attachment point may be varied as previously described to permit the location of the bib on the pillow to be adjusted.

Figure 2:
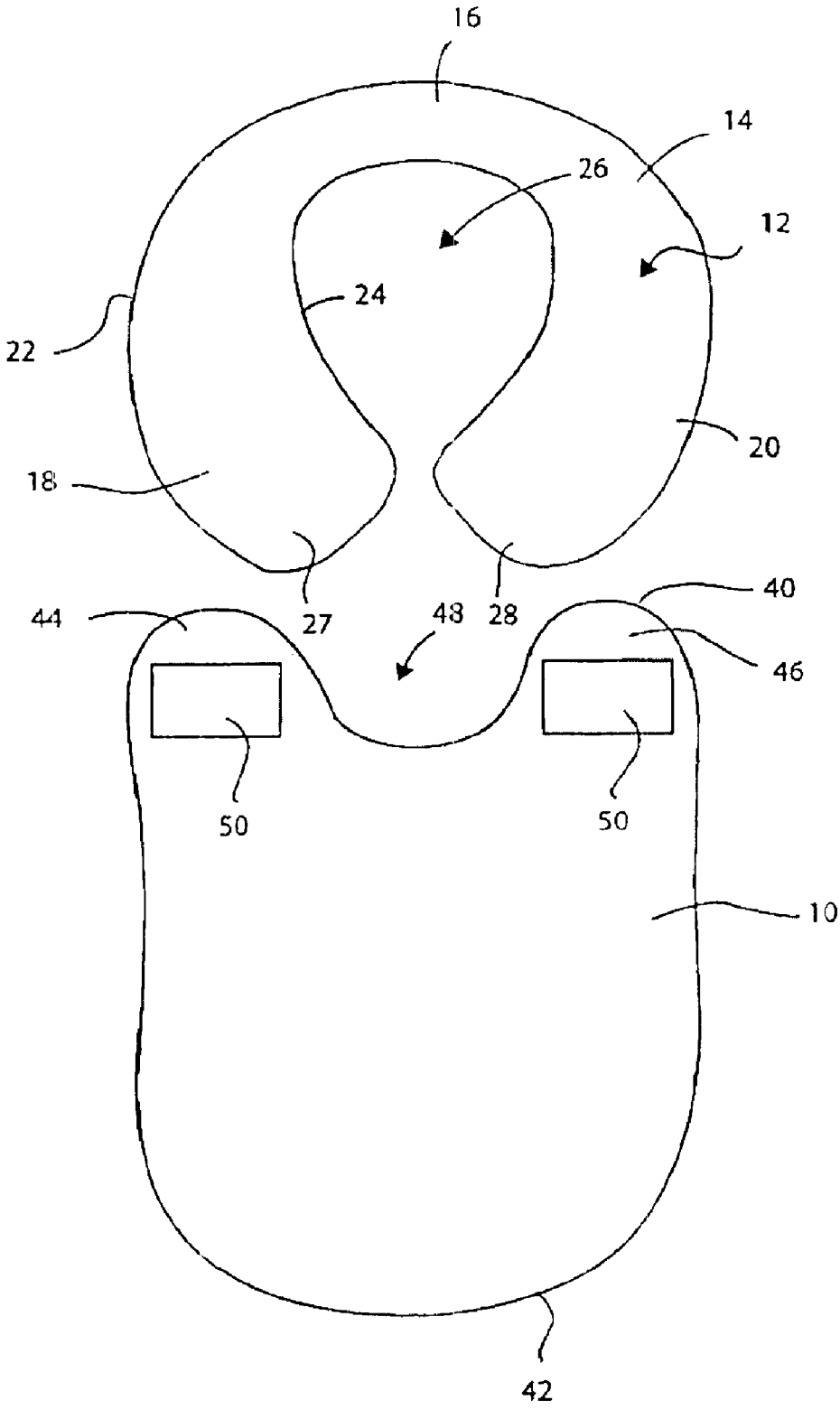
FIG. 2 is a top view of a bib and a neck pillow of the system of FIG. 1.
Figure 3:
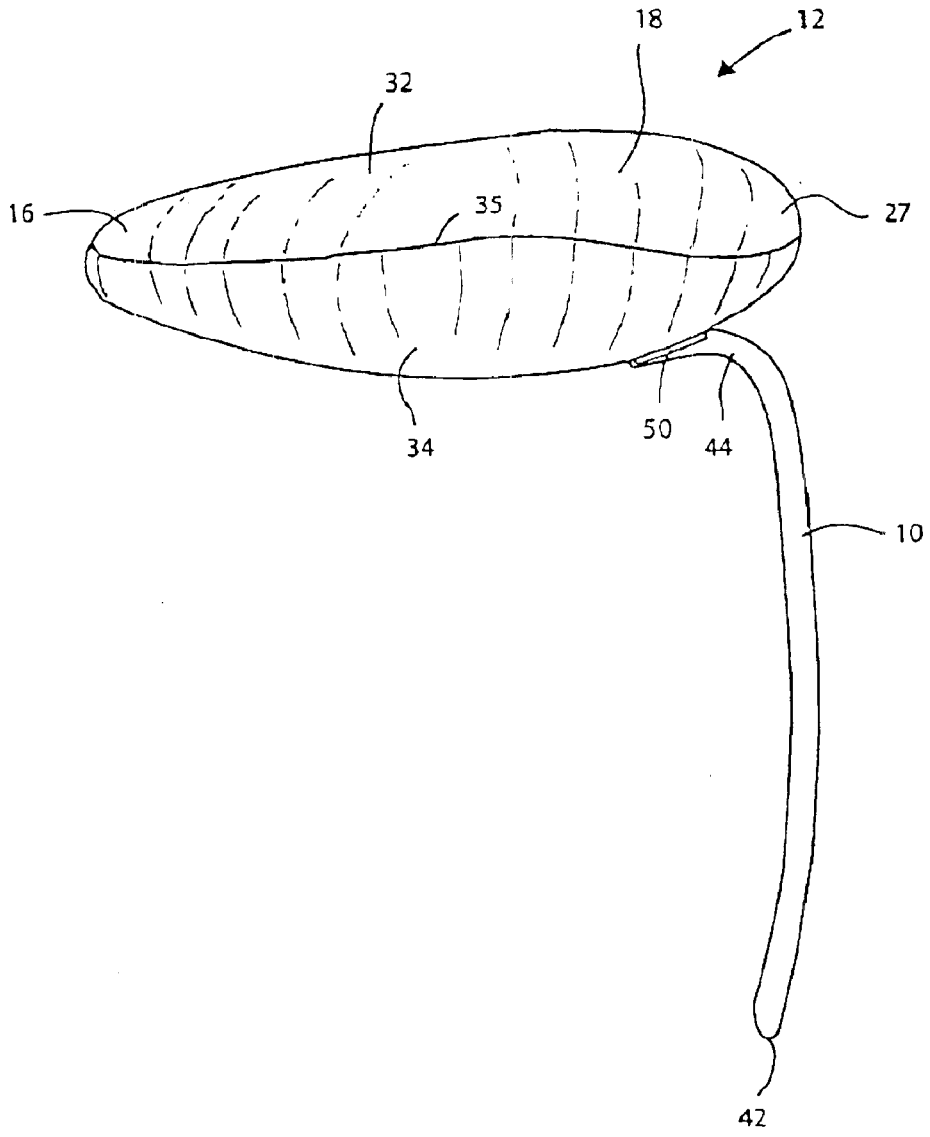
FIG. 3 is a side view of the bib system of FIG. 1, with the bib hanging downward.

Referring now to FIGS. 1–3, one embodiment of a bib 10 that is coupled to a neck pillow 12 will be described. Pillow 12 comprises a pillow body 14 having a medial region 16 and two arms 18 and 20 that extend from medial region 16. Pillow body 14 includes an outer periphery 22 and an inner periphery 24 that outlines a generally open well 26. Arms 18 and 20 have ends 27 and 28.

Pillow body 14 is constructed of a fill material, such as a hypoallergenic fill material that is encased in a fabric cover 30. Conveniently, pillow body 14 may be constructed using any of the techniques described in any of the patents or applications incorporated herein by reference. However, pillow body 14 may be constructed in other ways as well, such as by making it inflatable using a bladder. As shown, cover 30 comprises two halves 32 and 34 that are sewn together to form a seam 35 that extends around outer periphery 22 and inner periphery 24.

As best shown in FIG. 2, bib 10 is constructed of a top end 40, a bottom end 42. Top end 40 includes a pair of extended regions 44 and 46 and a recessed region 48. Secured to extended regions 44 and 46 are pieces of a hook and loop fastener material 50. Half 34 may be constructed of a fabric to which material 50 may adhere when it comes into contact with it. For example, half 34 may be constructed of a cotton or felt material. In this way, bib 10 may be attached to pillow body 14 by simple pressing material 50 against cover 30 at a desired location. In so doing, bib 10 becomes secured to pillow 12. To remove bib 10, it may simply be pulled from pillow 10. In this way, bib 10 may be coupled to pillow 10 at essentially any location simply by placing material 50 into contact with the pillow.

Recessed region 48 is designed to be placed below the baby's neck. Recessed region 48 may be generally curved so that it does not choke the baby, although other shapes may be used as well. Its position relative to the baby's neck may be adjusted by varying the location where material 50 is attached to ends 27 and 28.

As shown in FIG. 3, when pillow 12 is held generally horizontal, bib 10 hangs vertically. Pillow 12 is constructed to be sufficiently firm so that arms 18 and 20 do not sag or droop when held on the baby's shoulder's. Bib 10 is flexible so that it bends near where it is attached to pillow 12 so that it may hang down over the baby's chest.

Figure 4:
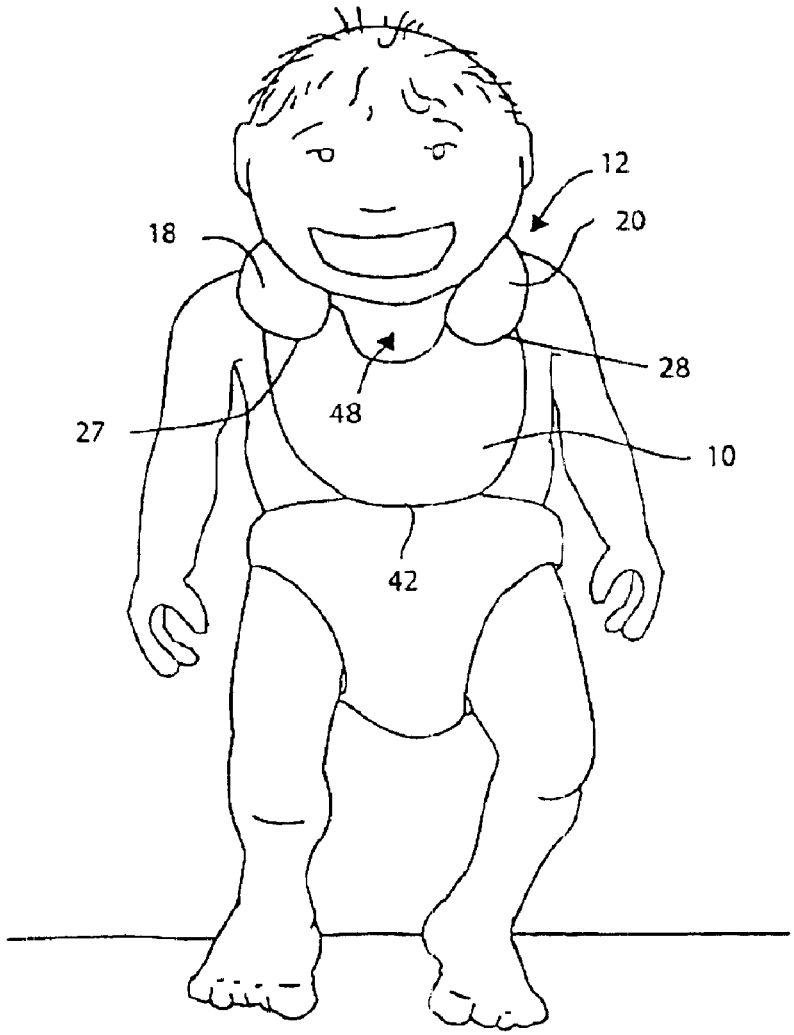
FIG. 4 illustrates the bib system of FIG. 1 when worn by a baby.

FIG. 4 illustrates bib 10 and pillow 12 when used with a baby. Initially, pillow 12 is placed around the baby's neck, either unattached to bib 10, or with bib 10 attached to one of the arms 18 or 20. Bib 10 is placed on the baby's shoulders, with medial region 16 being at the back of the neck and ends 27 and 28 being positioned by the baby's chest. Medial region 16 may bend of flex to permit arms 18 and 20 to fit around the baby's neck.

Bib 10 may be coupled to pillow 12 by attaching material 50 to ends 27 and 28. If the initial location is not correct, it may easily be adjusted by pulling the bib away from pillow 12 to disengage material 50 from cover 30 and then repeating the process at another location. This process may also be used to adjust the position of the recessed region 48 closer to the baby's neck to prevent foods or liquids from missing the bib.

When ready to remove bib 10, it may be pulled from pillow 12 in a manner similar to that just described. The bib 10 may then be washed in a sink, washing machine or the like as is know in the art.

The invention has now been described in detail for purposes of clarity and understanding. However, it will be appreciated that certain changes and modifications may be practiced within the scope of the appended claims.

What is claimed is:

1. A neck pillow system comprising:

a neck pillow comprising a pillow body having a medial region and two arms that each have an end, wherein the arms extend from the medial region to form a generally open well, and wherein the neck pillow is configured to be placed around a baby's neck, with the medial region being positioned at the baby's back and the two ends positioned at the baby's front; and a bib removably coupled to the pillow body near each of the ends to permit the bib to hang vertically down over the baby's chest.

2. A system as in claim 1, further comprises a fastener on the bib to removably couple the bib to the ends.

3. A system as in claim 2, wherein the fastener comprises a hook and loop fastener material.

4. A system as in claim 1, wherein the bib has a bottom end, a top end and two sides, and wherein the top end includes two extending regions and a recessed region, and wherein the two extending regions are configured to be coupled to the two ends.

5. A system as in claim 4, wherein the bib has a length in the range from about 5 inches to about 10 inches and a width in the range from about 5 inches to about 10 inches.

6. A system as in claim 4, wherein the extending regions have a width of about 1 inch to about 3 inches and wherein the recessed region is recessed about 2 inches to about 3 inches.

7. A system as in claim 1, wherein the pillow body comprises a fill material encased by a fabric cover.

8. A system as in claim 1, wherein the cover comprises a fabric and wherein the bib comprises a fabric.

9. A system as in claim 1, wherein the arms of the pillow body increase in width as they extend away from the medial region.

10. A system as in claim 1, wherein the medial region has a width of about 0.5 inch to about 2 inches, wherein the arms have a width of about 1 inch to about 3 inches and a length of about 4 inches to about 6 inches, and wherein the well has a width of about 2 inches to about 4 inches.

11. A system as in claim 1, wherein the ends have a thickness in the range from about 0.75 inch to about 2 inches, and wherein the thickness increases in a direction away from the medial region.

12. A method for securing a bib to a baby, the method comprising:

providing a neck pillow comprising a pillow body having a medial region and two arms that each have an end, wherein the arms extend from the medial region to form a generally open well;

placing the pillow body about the baby's neck, with the medial region being positioned at the baby's back and the two ends positioned at the baby's front; and removably coupling a bib to the pillow body near each of the ends after the neck pillow has been placed about the baby's neck, with the bib hanging vertically down over the baby's chest.

13. A method as in claim 12, further comprising removably coupling the bib to the pillow body using fasteners.

14. A method as in claim 13, wherein the pillow body includes a fabric cover, and wherein the fasteners comprise a hook and loop fastener material coupled to the bib, and further comprising contacting the fastener material to the fabric cover to removably couple the bib to the pillow.

15. A method as in claim 12, further comprising removing the bib from the pillow body and washing the bib.

16. A method as in claim 12, wherein the bib substantially covers the baby's chest.

17. A method as in claim 12, wherein the arms assist to support the baby's head in an upright orientation.

18. A method as in claim 12, wherein the ends are close to touching each other when placed about the baby's neck.

* * * * *